United States Patent [19]

Perrington et al.

[11] 4,123,309

[45] Oct. 31, 1978

[54] TRANSFER LETTER SYSTEM

[75] Inventors: Kenneth J. Perrington, New Brighton; Phillip A. Taylor, Lake Elmo; Peter J. Vogelgesang, Roseville, all of Minn.

[73] Assignee: Minnesota Mining and Manufacturing Company, St. Paul, Minn.

[21] Appl. No.: 420,310

[22] Filed: Nov. 29, 1973

Related U.S. Application Data

[63] Continuation-in-part of Ser. No. 318,257, Dec. 26, 1976, abandoned.

[51] Int. Cl.[2] ..... G03C 5/16; B41B 13/00

[52] U.S. Cl. ..... 156/234; 101/470; 156/241; 156/249; 156/272; 250/316; 427/56

[58] Field of Search ..... 156/230, 234, 241, 240, 156/247, 272–276, 277, 249; 117/38, 3.1, 3.2, 3.4, 8.5, 93.31, 35.5, 35.6, 36.1, 36.2, 36.3, 36.7, 36.4; 101/473, 467, 470, 401.1; 250/316, 318; 161/23; 96/27, 28; 427/56; 428/913, 914, 206, 323, 327, 408, 488

[56] References Cited

U.S. PATENT DOCUMENTS

| | | | |
|---|---|---|---|
| 3,315,598 | 4/1967 | Owen | 156/230 |
| 3,472,164 | 10/1969 | Newman et al | 117/3.4 |
| 3,476,937 | 11/1969 | Vrancken | 117/36.1 |
| 3,570,380 | 3/1971 | Kamenstein | 250/316 |
| 3,592,644 | 7/1971 | Vrancken et al | 117/36.1 |
| 3,605,620 | 9/1971 | Mueller | 250/316 |
| 3,640,219 | 2/1972 | Famham et al | 250/318 |
| 3,674,588 | 7/1972 | Lambrechts | 101/470 |
| 3,694,245 | 9/1972 | Anderson | 250/318 |
| 3,751,318 | 8/1973 | Newman | 156/272 |

FOREIGN PATENT DOCUMENTS

| | | |
|---|---|---|
| 67,192 | 6/1967 | Australia. |
| 1,957,126 | 5/1970 | Fed. Rep. of Germany. |
| 2,046,524 | 10/1973 | Fed. Rep. of Germany. |
| 403,806 | 6/1966 | Switzerland. |
| 1,156,996 | 7/1969 | United Kingdom. |

*Primary Examiner*—Douglas J. Drummond
*Assistant Examiner*—Michael W. Ball
*Attorney, Agent, or Firm*—Cruzan Alexander; Donald M. Sell; William L. Huebsch

[57] ABSTRACT

A composite strip material for forming graphics such as letters, numbers, symbols or pictures. The strip includes an accepting tape comprising a layer of latent adhesive material in face-to-face contact with a layer of microgranules lightly adhered to a donor web. At least one of the layers bears a radiation absorbing pigment which, when selectively heated in accordance with a pattern of radiation, momentarily softens adjacent portions of the adhesive material. Upon separation of the accepting tape and donor web, microgranules transfer to the accepting tape only in irradiated areas.

4 Claims, 9 Drawing Figures

FIG. 6
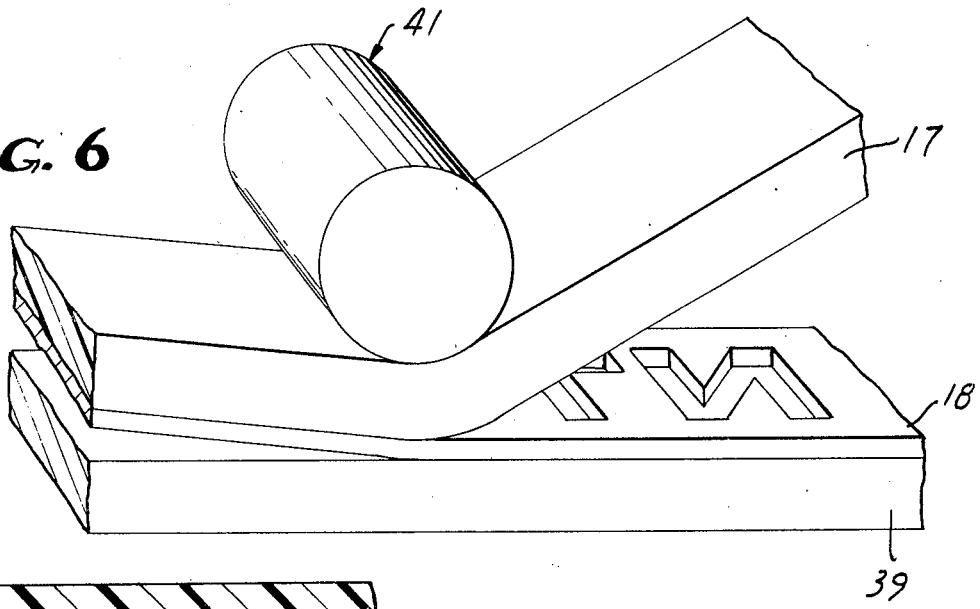
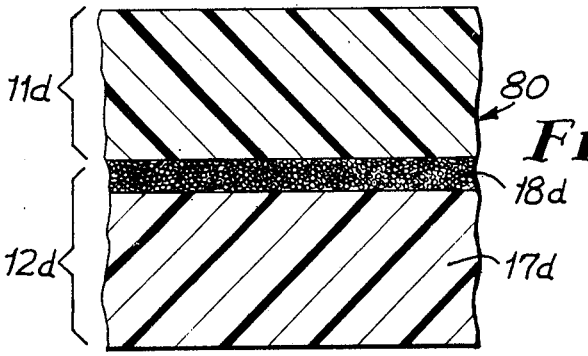
FIG. 9
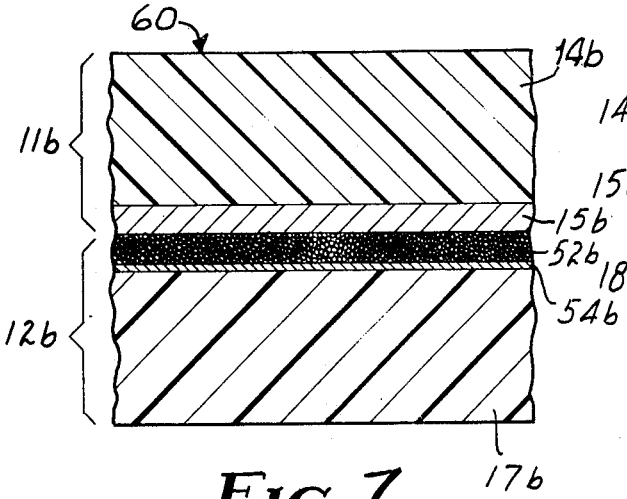
FIG. 7
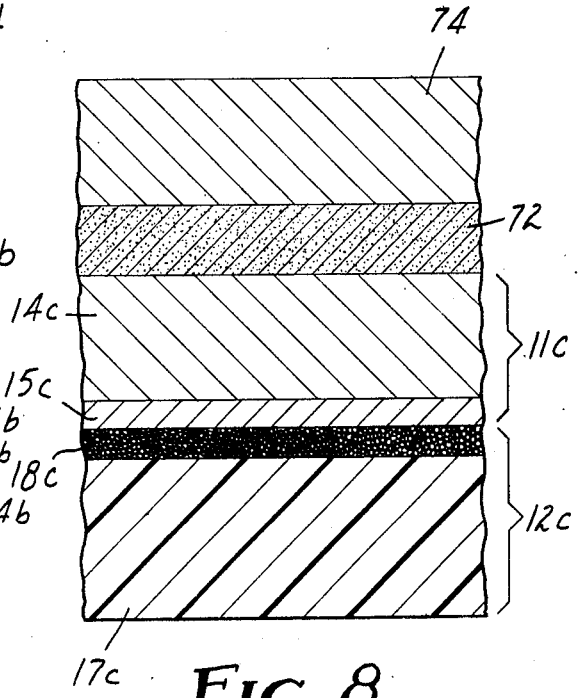
FIG. 8

TRANSFER LETTER SYSTEM

CROSS REFERENCE TO RELATED APPLICATIONS

This application is a continuation-in-part of U.S. Pat. Application No. 318,257, now abandoned, filed Dec. 26, 1972, and is related to U.S. Pat. Application Ser. No. 318,256, filed Dec. 26, 1972, and U.S. Pat. Application Ser. No. 406,548 filed Oct. 15, 1973 which is a continuation-in-part of U.S. Pat. Application Ser. No. 318,258 filed Dec. 26, 1972, now abandoned.

FIELD OF THE INVENTION

This invention relates to forming graphics such as letters, numbers, symbols and pictures and in one aspect to forming graphics which may be transferred to a substrate.

BACKGROUND OF THE INVENTION

Many systems are known by which graphics may be applied to the substrate of an artwork more quickly than by manual inscription. One system comprises a series of graphics releasably performed on a backing sheet and having pressure sensitive adhesive on their exposed surfaces. A graphic selected from the sheet may be transferred by positioning its adhesive coated surface against a substrate and rubbing the backing sheet to adhere the graphic to the substrate while breaking its releasable bond to the backing sheet. With this system each letter must be individually oriented on the artwork, a large stock of sheets of graphics is normally required, and the system is often wasteful since the apportionment of graphics on a sheet seldom corresponds to a user's requirements.

Other systems designed to avoid these problems selectively form graphics along a coated strip material by a series of light exposures through a template. In one such system the exposed area changes color, but in another system the exposed area is latent and cannot be seen until developed photographically (see U.S. Pat. No. 2,742,831). Neither system permits the graphics to be transferred so that the entire strip must be adhered to a substrate.

U.S. Pat. No. 3,490,362 suggests a system in which adhesive coated graphics are sequentially die cut from a colored adhesive coated material through a transparent deformable carrier strip. The graphics are carried in spaced relationship by the carrier strip until they are transferred to a substrate. The intricacy of graphics formed by die cutting is limited, however, and the fractured edges of die cut graphics may be too ragged for many applications.

ADDITIONAL PRIOR ART

The closest known prior art is from generally unrelated areas of the printing art. U.S. Pats. Nos. 2,208,777, 2,954,311 and 2,955,531 are specifically noted.

SUMMARY OF THE INVENTION

The present invention makes possible the production of graphics which are made immediately visible and thus can be accurately positioned along a strip, which graphics can be formed with such resolution that even half-tone photographs may be reproduced. The strip of graphics may be used as artwork, or the graphics may be adapted for transfer from the strip to an artwork substrate.

Briefly, the graphics are formed along a composite strip material comprising (1) an accepting tape comprising a layer of latent adhesive material and (2) a transfer tape comprising a donor web carrying a lightly adhered layer of microgranules in face-to-face contact with the layer of adhesive material. At least one of said microgranule and adhesive layers bears a radiation absorbing pigment. For example, the pigment may be incorporated into one of said layers or, if the accepting tape comprises a receiving web bearing a coating of adhesive, between the adhesive coating and the receiving web. The strip material should be essentially transparent to radiant energy between one exterior surface and the pigment so that the pigment may be exposed to heat-producing radiation. Upon momentary exposure to a pattern of radiation, the pigment is selectively heated and momentarily softens the adjacent portions of the layer of adhesive material which, upon solidification, adhere to the microgranules. The graphic formed by the pattern of radiation becomes immediately visible, thus making it easy to position the pattern of radiation for the next graphic. After all of the graphics have been formed, the accepting tape and donor web are separated, transferring microgranules to the accepting tape only in irradiated areas.

The composite strip material must receive momentary, intense radiation in a sharply defined pattern to form sharply defined graphics. The adhesive material must soften and solidify almost instantaneously to insure a negligible lateral conduction of heat into the adhesive layer adjacent the pattern of received radiation. A xenon flash lamp which produces broad spectrum bluish white light in a flash having a duration of under about 3 milliseconds is the preferred means for providing such radiation. The minimum radiant energy required to form a graphic is approximately 5 watt seconds per square inch of exposed strip material, preferably at least 50 watt seconds (e.g., at least 25,000 watts for 2 milliseconds per square inch of exposed strip material). In a xenon exposure system estimated to be initially 70 percent efficient, an energy input to the lamp of 100 watt seconds per square inch of area to be exposed has been found to form excellent graphics and to provide sufficient excess energy to compensate for line voltage changes and subsequent efficiency decreases due to aging of the lamp.

The pattern of radiation may be provided by briefly directing radiation toward a general area of the exterior surface of the composite strip material while masking the directed radiation except in a graphic pattern through the use of an opaque template having a sharply defined radiation transmissive window. Because the xenon flash lamp does not provide a point source of radiation, it is desirable that the template be in intimate contact with the transparent web for optimum edge resolution in the pattern of radiation received by the pigment. The template is preferably highly reflective so that it may be very thin and will not be heated sufficiently by any blocked radiation which might otherwise partially soften the adhesive material in nonirradiated areas. A preferred template comprises a radiation transparent film having a highly reflective coating with at least one sharply defined opening providing the window through the template corresponding to a graphic to be formed. A bright copper coating has been found suitable for use with a xenon flash lamp up to 100,000 watts per square inch of area exposed over a period of about 2 milliseconds, while a bright aluminum coating, which has a reflectivity of over 88 percent for most of the wavelengths of light produced by a xenon flash lamp, has been found suitable where the radiant energy may be greater.

The pigment should efficiently absorb radiation. Carbon black, which approches the absorption efficiency of a black body, is a preferred pigment. The entire light spectrum produced by a xenon flash lamp is apparently absorbed when the pigment used is carbon black, because it has been shown experimentally that the efficiency of the radiation transfer to the strip material is decreased when any of the spectrum is filtered out.

Preferably the pigment is incorporated into the layer of microgranules. This location provides a direct conductive path to the surface of the adhesive layer to be softened. The pigment serves also as a coloring material for the microgranules and results in dark graphics. When the pigment is in the layer of microgranules, the strip material is preferably irradiated through the receiving web to first heat the surface of the microgranules contacting the adhesive material, in which case the receiving web and the layer of adhesive material should be essentially transparent to radiation.

Where graphics of a light color are desired, microgranules of that light color may be used in combination with an accepting tape which comprises a receiving web, a coating of pigment on the receiving web, and a thin layer of adhesive material adhered to the pigment coating. Upon radiation heating, the pigment softens the thin adhesive layer from the side opposite the layer of microgranules. In this location of the pigment, slightly greater radiation intensity is required than when the pigment is in the layer of microgranules.

The microgranules should be discrete particles which may be homogeneous, e.g., wholly thermoplastic resin, or heterogeneous, e.g., glass beads coated with thermoplastic resin. Mixtures of diverse particles may be used, e.g., a mixture of thermoplastic particles and iron oxide particles. The microgranules are joined together, e.g., by fusing thermoplastic particles to each other or by addition of an adhesive, but they should be so joined that the layer is friable and separates between the microgranules. A class of thermoplastic resins which readily provide particulate coatings from aqueous dispersions are the ionomer resins such as acid-modified etylene/vinyl acetate copolymer (e.g. "Elvax" D-1288).

The microgranules should be sufficiently small to afford a separating line generally normal to the surface of the donor web, which separating line closely conforms to the periphery of an irradiated area so that the edge of the graphic will be clean and sharp. Microgranules having an average diameter up to 4 to 5 microns are deemed suitable, about 0.3 to 1 micron being preferred.

The layer of microgranules should have sufficient thickness to provide the optical density or opaqueness required of the graphics to be formed for a particular application. The desired opacity may be provided by using opaque microgranules or by filling the interstices between the microgranules with a pigment such as the aforementioned radiation absorbing pigment. A preferred construction employs microgranules of acid-modified ethylene/vinyl acetate copolymer and one part carbon black to 6 parts by weight of the microgranules. A 200 to 220-microinch (5 to 5.5 micrometer) filled layer of the microgranules has been measured to have an optical density of about 3.0. The thickness for any specific application may be estimated from this measurement. When using graphics formed according to the present invention directly as a mask for blocking ultraviolet light in the production of printing plates and silk screens, an optical density of 2 is acceptable, and a thickness of 180 microinches (4.5 micrometers) provides an optical density sufficiently in excess of 2 to provide a margin of safety. When a layer of the above-identified microgranules incorporates titanium dioxide at a ratio by weight to the microgranules of 1 to 2, a 250-microinch (6 micrometer) layer of microgranules is required to produce white graphics having an optical density of 0.3. These white graphics transferred to a black substrate will provide sufficient contrast for making television cards from which white images may be electronically superimposed on television pictures. There should never be any need for the thickness of the microgranule layer to exceed 0.001 inch (25 micrometers).

When the webs are separated subsequent to exposure of the strip material, the entire thickness of the microgranular layer in the irradiated areas of the strip material should adhere to the accepting tape. This will insure that the graphics formed will have the predetermined thickness and opacity. Also the microgranular layer remaining on the donor web will have clean openings corresponding to the graphics formed, and can be used as a negative artwork, especially when the color of the donor web contrasts with that of the microgranules.

When the layer of microgranules is generally nonporous, the softened adhesive material will not penetrate the layer of microgranules, in which case the layer of microgranules should have greater cohesive strength than its adhesive strength to the donor web. When the layer of microgranules is porous and the adhesive strength of the microgranules to the donor web is greater than the cohesive strength between the microgranules, the adhesive material must be sufficiently fluid upon irradiation of the strip material to flow into the interstices and adhere to each individual microgranule.

If the microgranules comprise a thermoplastic resin which acts as an adhesive upon softening, the graphics carried by the accepting tape can be adhered to a substrate simply by application of sufficient heat through the accepting tape to soften the thermoplastic resin. Moreover, the microgranules remaining on the donor web after separation of the accepting tape can be adhered to a substrate by the application of heat through the donor web, and the donor web may be peeled away to leave a negative of the graphics.

Where the microgranules consist only of thermoplastic resin, the microgranular layer should contain an appreciable amount of dispersed pigment in order to provide sharply defined graphics. About one part of carbon black per 6 parts by weight of microgranules or about one part of other pigments such as titanium dioxide per 2 parts by weight of microgranules are perferred. If the loading of the pigment is too high, adhesion to substrates may be inhibited. Good adhesion is generally achieved where the amount of carbon black is one part or less per 4 parts of the thermoplastic microgranules.

When the accepting tape includes a receiving web, the adhesive layer should be coated on the receiving web in the thinnest layer (preferably less than 0.001 inch) which affords adequate adhesion to the microgranules so that radiant energy requirements to soften the adhesive material are minimized. The adhesive material should soften over a relatively narrow temperature range which is sufficiently above room temperature (e.g., above 60° C) to permit shipping and storage without refrigeration. During the instantaneous softening of the adhesive material, it should wet and adhere to the microgranules. When the strip material is of the type which affords transfer of the graphics from the receiving web to a substrate, the adhesive material, which is softened during the transfer, should be sufficiently tacky when softened so that the receiving web will not tend to slip on the substrate and damage the graphics being transferred. Whether or not the accepting tape includes a receiving web, the softened adhesive material preferably should have little tendency to transfer to the substrate to which the graphics are transferred, and should be relatively clear so that portions which do transfer will not detract from the visual appearance of the graphics.

An adhesive material which may be used with a receiving web comprises a high percentage of a paraffin wax which softens upon a low energy input at a sharply defined softening temperature of 60° C. For a strip material adapted for forming transferable graphics, it is a preferred to employ approximately equal portions of the paraffin wax and each of two other adhesive materials, namely (1) an ethylene/vinyl acetate copolymer, preferably with about 18 percent vinyl acetate (e.g., "Elvax" 460) to restrict slippage of the receiving web on the substrate when the adhesive material is softened during transfer, and (2) a clear polymerized hydrocarbon (e.g., "Polyeth" 70053) to restrict transfer of the adhesive material from the web during transfer of the graphics.

The donor web and the accepting tape should have sufficient strength and dimensional stability over the temperature range to which the strip material is subjected to prevent distortion of the graphics. Additionally, the donor web should provide low adhesion to the microgranules. Where the accepting tape includes a receiving web, it should provide good adhesion to the solidified adhesive layer. A suitable material for both the donor web and the receiving web is biaxially-oriented polyethylene terephthalate film of 0.001 inch (0.025 mm) thickness. The donor web or accepting tape may be adapted for direct application to a substrate after formation of the graphics by coating the side opposite the microgranules with a pressure-sensitive adhesive. The pressure-sensitive adhesive should be protected by a releasable overlay which may be stripped away to permit application.

BRIEF DESCRIPTION OF THE DRAWING

The invention will be further described with reference to the accompanying drawing wherein like numbers refer to like parts in the several views, and wherein:

FIG. 6 is a fragmentary perspective schematic view of the separated donor web of FIG. 4 illustrating the transfer of the layer of microgranules to a substrate, which layer provides a negative of the graphics;

FIG. 7 is a fragmentary sectional schematic view of a third embodiment of the composite strip material according to the present invention;

FIG. 8 is a fragmentary sectional schematic view of a fourth embodiment of the composite strip material according to the present invention; and FIG. 9 is a fragmentary sectional schematic view of a fifth embodiment of the composite strip material according to the present invention.

DESCRIPTION OF THE PREFERRED EMBODIMENT

Figure 1:
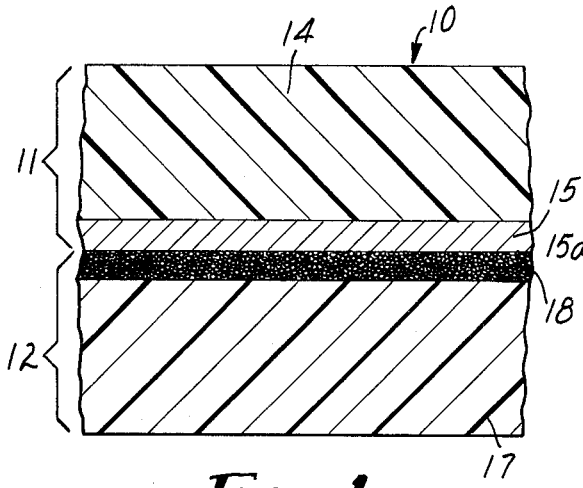
FIG. 1 is a fragmentary sectional schematic view of a first embodiment of the composite strip material according to the present invention.

FIG. 1 shows a first preferred embodiment of the composite strip material according to the present invention generally designated by the numeral 10, which embodiment is preferred for forming dark colored graphics. The strip material 10 consists of an accepting tape 11 and a transfer tape 12. The tapes 11 and 12 each include a coating and are positioned with the coatings in face-to-face relationship.

The accepting tape 11 consists of a strong, thermally stable receiving web 14 and a firmly adhered coating or layer of adhesive material 15 having a narrow softening range above normal ambient or room temperature. Both the receiving web 14 and the adhesive material 15 are essentially transparent to radiation. The transfer tape 12 has a strong thermally stable donor web 17 and a coating or layer of microgranules 18 releasably adhered to the donor web. A radiation absorbing pigment such as carbon black is incorporated in the layer of microgranules 18. The pigment contacts the adhesive material 15 at the interface between the tapes 11 and 12.

Figure 3:
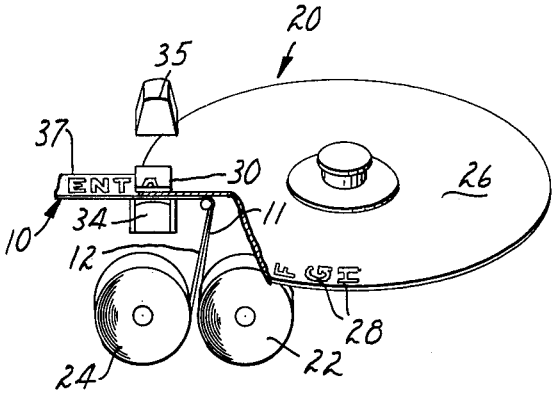
FIG. 3 is a schematic perspective view of a device for forming graphics on the composite strip material of FIG. 1.

FIG. 3 schematically illustrates a suitable device, generally designated by the numeral 20, for forming graphics along the strip material 10 according to the present invention. The device 20 represents the device more fully described in U.S. Patent Application Ser. No. 406,548, filed Oct. 15, 1973, which is a continuation-in-part of U.S. Pat. Application Ser. No. 406,548, filed Oct. 15, 1973, which is a continuation-in-part of U.S. Pat. Application No. 318,258 filed Dec. 26, 1972, now abandoned; the disclosure whereof is incorporated herein by reference.

Briefly, the device 20 includes means for supporting reels 22 and 24 of the tapes 11 and 12, respectively, and for guiding the tapes along a path with the layer of adhesive material 15 and layer of microgranules 18 in face-to-face relationship to provide the composite strip material 10.

An opaque template is provided by a thin radiation-transparent disc 26 having a highly reflective metallic coating on its underside. Sharply defined openings in the metallic coating provide a series of windows 28 in the shape of graphics to be formed. The disc 26 is rotatably mounted to position any of the windows 28 over the receiving web 14 of the strip material 10. The glass plate 30 is disposed above the positioned window, and a plunger 34 is mounted for movement to provide clamping means for pressing the strip material 10 and the disc 26 against the glass plate. A xenon flash lamp 35 then irradiates the strip material 10 through the glass plate 30 and the aligned window.

The device 20 also includes manually operated drive means (not shown) for advancing the strip material 10 along the path between exposures by the xenon flash lamp 35, so that graphics 37 may be formed seriatim along the strip material 10.

Figure 4:
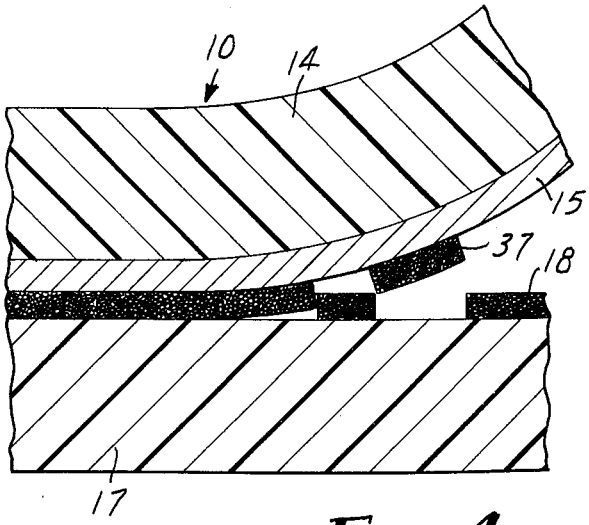
FIG. 4 is a fragmentary sectional schematic view of the composite strip material of FIG. 1 having graphics formed thereon and partially separated to show the transfer of microgranules from a donor web to a receiving web.

Subsequent to exposure, the donor and receiving webs 17 and 14 of the strip material 10 may be separated as illustrated in FIG. 4. Microgranules from the layer 18 adhere to that portion of the layer of adhesive material 15 which was softened upon exposure by the xenon flash lamp 35 and transfer to the receiving web 14 in accordance with the pattern of received radiation. Such transfer provides sharply defined graphics 37 on the receiving web 14 and an equally sharply defined negative of those graphics in the microgranules remaining on the donor web 17.

Figure 5:
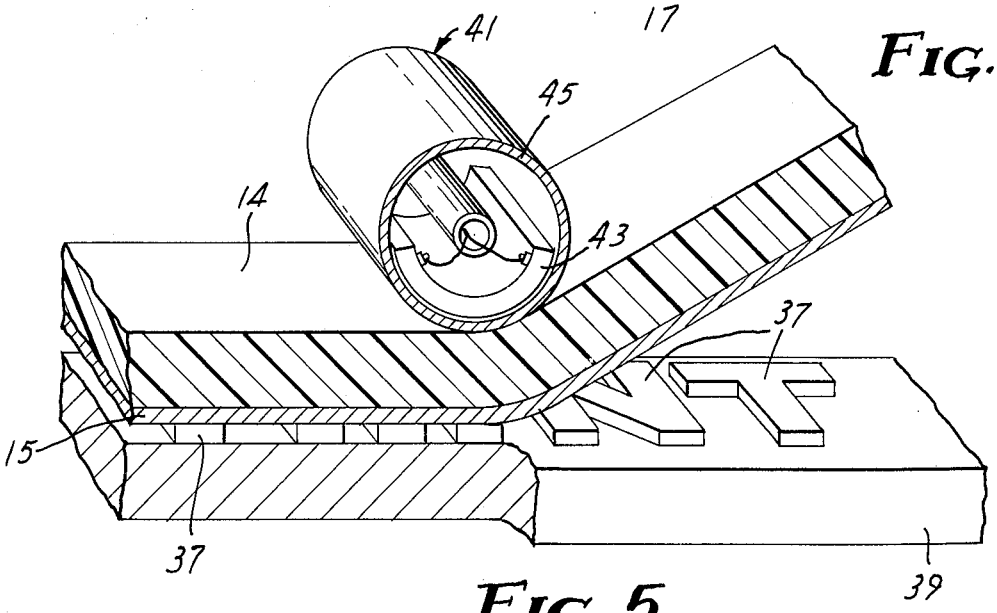
FIG. 5 is a fragmentary perspective schematic view of the separated receiving web of FIG. 4 illustrating the transfer of graphics from the receiving web to a substrate in the practice of the present invention.

If the layer of microgranules 18 comprises a thermoplastic resin having adhesive properties upon softening, graphics 37 formed on the receiving web 14, or the negative thereof on the donor web 17, may be transferred to a substrate by application of heat through the web 14. As illustrated in FIG. 5, microgranules defining the graphics 37 are positioned adjacent a substrate 39 and are activated by the application of heat from a hand guided heating member 41 pressed against and drawn along the opposite surface of the receiving web 14. The heat softens the adhesive material 15 and allows the receiving web to be peeled away. Similarly, a negative of the graphics may be transferred to the substrate 39 by application of heat against the separated donor web 17 as shown in FIG. 6.

The heating member 41 may comprise an electrical resistance heating element 43 in a metal housing 45 which is controlled by a conventional thermostat (not shown) to maintain the periphery of the housing adjacent the heating element at a predetermined temperature.

Figure 2:
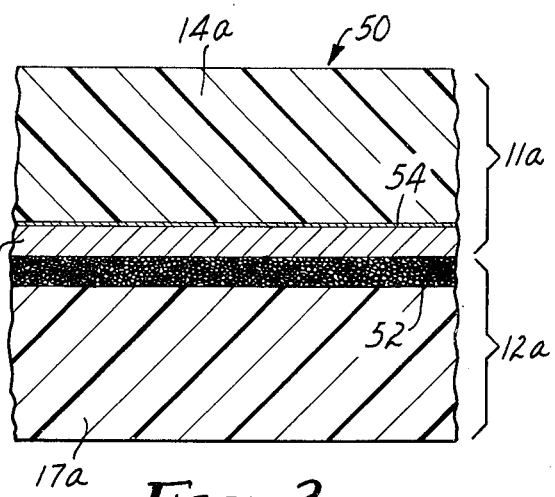
FIG. 2 is a fragmentary sectional schematic view of a second embodiment of the composite strip material according to the present invention.

FIG. 2 shows a second embodiment of the composite strip material according to the present invention, generally designated by the numeral 50, and having webs or layers which are similar to those of the strip material 10 of FIG. 1 similarly numbered. The embodiment illustrated by the strip material 50 is particularly useful for the formation of light clored graphics. The strip material 50 comprises an accepting tape **11*a* and a transfer tape 12*a*, The transfer tape 12*a* comprises a donor web 17 *a* and a releasably adhered coating or layer of thermoplastic microgranules 52 which may incorporate a light colored material, such as titanium dioxide. The accepting tape 11*a* has a radiation transparent receiving web 14*a* carrying a firmly adhered coating 54 of a radiation absorbing pigment such as carbon black in a polylmeric binder. An adhesive layer 15*a* covers the pigmented coating 54. Graphics may be formed using the device 20 illustrated in FIG. 3 by selectively irradiating through the receiving web 14*a* to heat the pigmented coating 54 and soften the adjacent adhesive material so that microgranules from the layer 52 are ransferred to the receiving web 14*a* upon separation from the donor web 17*a*. After heat transfer to a substrate as in FIG. 5, the pigmented coating 54 is stripped away with the receiving web 14*a***, leaving light colored graphics.

Referring to FIG. 7, the composite strip material 60 likewise provides light colored graphics. Its acccepting tape **11*b* consists of a radiation-transparent receiving web 14*b* and an adhesive layer 15*b*. The donor web 17*b* of its transfer tape 12*b* has a firmly adhered coating 54*b* of carbon black in a polymeric binder. Lightly adhered to the coating 54*b* is a layer 52*b* of microgranules and titanium dioxide pigment. When the strip material 60 is irradiated in graphic patterns through the receiving web 14*b*, heat generated in the carbon black layer 54*b* and/or the titanium dioxide pigment of the layer 52*b* melts adjacent portions of the adhesive layer 15*b* to form graphics which transfer to the receiving web 14*b***. Since virtually no carbon black is transferred, the resulting graphics are light colored.

FIG. 8 shows composite strip material which is similar to the strip material 10 (with similar parts being similarly numbered) except that the donor web **17*c* must be transparent to radiation, and the receiving web 14*c* has a coating of pressure-sensitive adhesive 72 on the side opposite the layer of waxy material 15. The adhesive coating 72 is covered by a removable protective overlay 74. After forming graphics by irradiating through the donor web 17*c*, the overlay 74 may be peeled from the separated receiving web 14*c*** to expose the adhesive coating by which the graphics may be firmly adhered to a substrate.

FIG. 9 shows a composite strip material 80 which is similar to the strip material 10 except that the accepting tape **11*d* consists only of a layer of adhesive material in face-to-face contact with the microgranules 18*d* on the donor web 17*d* of the transfer tape 12*d***. Self-supporting layers of adhesive material which have been determined to be useful for the present invention include films of ethylene/vinyl acetate and low-molecular-weight terephalate polyesters. For best results, such films should have a thickness of 10–80 micrometers and have softening points in the range of 50° - 95° C (ASTM method E-28, Part 30).

The present invention will be better understood with reference to the following non-limiting examples wherein all parts are by weight unless otherwise specified.

EXAMPLE 1

To prepare a dispersion of pigment and microgranules 18 for making a transfer tape 12 as shown in FIG. 1, an open mixing vessel was charged with 180 parts of deionized water, 6 parts of 12N ammonium hydroxide, and 10 parts of sodium salt of a condensed naphthalene sulfonic acid (e.g., "Tamol S.N."). The charge was mixed for about 5 minutes, after which 50 parts of carbon black pigment were slowly added with continued mixing so as to restrict the formation of large lumps. The resultant mixture was pumped through a sandmill charged with one thirty-second inch diameter glass beads (approximately four hours) until the mixture appeared mirror smooth under a sixty power microscope fitted with an oblique light source.

Forth-Nine parts of a 50% aqueous disperson of acid-modified ethylene/vinyl acetate copolymer ("Elvax" D-1288) were charged to an open vessel fitted with a motorized propeller mixer, and 20 parts of the sand-milled mixture containing the carbon black (containing approximately 20% solids) were slowly added thereto, with care being taken not to mix air into the resulting dispersion. This was passed once through a homogenizer of the type sold under the trade designation "Gaulin". Twenty-five parts of the homogenized material diluted by 75 parts of deionized water were returned to the open vessel, and to this was slowly added 1½ parts of a thickening agent, namely a high molecular weight polymer containing a large amount of carboxylic acid groups (e.g., Rohm & Haas "Arcrysol ASE-95"). To the thickened mixture was added one part of a non-ionic wetting agent (e.g., "Igepol" CA-630).

The final dispersion was then coated with a knife coater and dried at a temperature of less than 60° C to form a 180-microinch (4.5 micrometer) thick dry layer on a biaxially-oriented polythylene terephthalate donor web 17. The dry layer was found to be generally microgranular and almost free of voids. The microgranules had an average diameter of about 0.3 to one micron.

To make an accepting tape 11, waxy adhesive material was prepared by charging 80 parts of toluene to an open vessel and adding 6½ parts each of a paraffin wax, a polymerized hydrocarbon (e.g., "Polyeth" 70053), and an ethylene/vinyl acetate copolymer (e.g., "Elvax"460).

This mixture was heated to 95° C and stirred gently to effect solution.

The heated solution was coated on one-mil (0.025 mm) transparent biaxially-oriented polyethylene terephthalate film from a gravure metering roll with a 70-line per inch (178-line per cm) knurl. the resultant coating was smoothed by contact with a curved smoothing blade heated to 95° C and then dried to a thickness of 200 microinches (5 micrometers).

The adhesive material 15 on the resulting accepting tape 11 was positioned in face-to-face relationship with the microgranular layer 18 of the transfer tape 12. The resulting strip material 10 was subjected to a pressure of about 50 pounds per square inch (3.5 kilograms per square centimeter) and exposed through the accepting tape 11 by a xenon exposure system as illustrated in FIG. 3 which was estimated to be about 70 percent efficient. A copper coated reflective template 26 was used. When the xenon lamp 35 was regulated for a flash of about 2 milliseconds' duration and had an energy input of 50 watt seconds per square inch of lamp exposure area (7.7 watt seconds per square centimeter), sharply defined graphics were formed having resolution of over 200 lines per inch (79 lines per cm). Similar exposures with power input to the xenon lamp of 100 watt seconds per square inch of lamp exposure area (15.5 watt seconds per square centimeter of lamp exposure area) provided a higher degree of reliability for the formation of graphics, with a slight increase in resolution.

Exposure for 2 milliseconds with energy input to the xenon lamp of more than 200 watt seconds per square inch of exposure area (31 watt seconds per square centimeter of exposure area) required the use of an aluminum coated template 26 since a copper coated template permitted partial softening to the adhesive material 15 in areas adjacent to the irradiated areas.

When the donor and receiving webs 17 and 14 were separated subsequent to exposure under each of the above conditions, the entire thickness of the layer of microgranules 18 in the irradiated areas of the strip material 10 adhered to the layer of adhesive material 15 on the receiving web 14.

Graphics 37 formed on the accepting tape 11 were easily transferred to a fibrous substrate such as paper by positioning the graphics 37 adjacent the substrate and applying a heater 41 at 80° to 115° C to the exposed side of the receiving web 14. The graphics 37 had little tendency to slip and deform during application. The majority of the layer of adhesive material 15 remained on the receiving web 14 after it was stripped away, and that adhesive material which did transfer did not detract from the appearance of the graphics.

The microgranules remaining on the donor web 17, which had openings corresponding to the graphics 37 formed on the accepting tape 11, were easily transferred from the donor web 17 to a fibrous substrate by use of the heater 41 in the manner previously described.

EXAMPLE 2

A strip material ws made as in Example 1, except that the transfer tape 12 was made using a dispersion with 30 parts (rather than 20 parts) of the sandmilled mixture containing the carbon black.

The resolution of graphics formed with this strip material was very similar to the resolution of graphics 37 formed with the strip material prepared in Example 1. Upon transfer of the graphics to certain substrates, the thermoplastic microgranules did not adhere as firmly as would be desired for some applications because of the high loading of carbon black.

EXAMPLE 3

A strip material was made as in Example 1, except that the transfer tape 12 was made using a dispersion with 15 parts (rather than 20 parts) of the sandmilled mixture containing carbon black.

The performance of this strip material was very similar to the performance of the strip material prepared in Example 1, except that the graphics formed were deemed to have slightly less, but still adequate, opacity.

EXAMPLE 4

A strip material was made as in Example 1, except that the accepting tape was made with 20 parts of a natural paraffin wax, and the polymerized hydrocarbon and the ethylene/vinyl acetate copolymer were omitted from the adhesive layer.

The resolution of graphics formed with this strip material was as good or better than that for the graphics formed with the strip material of Example 1 under similar conditions, presumably because of the lower and more sharply defined melting point (141.5° F) afforded by the adhesive material of the present example.

Transfer of the graphics formed to a substrate was more difficult, however, due to a tendency for the receiving web to skid on the melted layer of adhesive material contacting the substrate and thereby distort the graphics being transferred. Additionally, when the heating member 41 shown in FIG. 5 was used to transfer the graphics, the melted adhesive material had a strong tendency to transfer to the substrate and leave an undersirable visible waxy film arond the transferred graphics. Such transfer of the adhesive material was remarkably reduced by the use of a radiant heating member such as a 200 watt light bulb focused by a reflector. The radiation was selectively absorbed by the pigment to heat and activate the adhesive microgranules in the graphics without appreciable softening of the adhesive material.

EXAMPLE 5

A strip material was made as in Example 1, except that 14 parts of paraffin wax and 6 parts of the polymerized hydrocarbon were used, and the ethylene/vinyl acetate copolymer was omitted.

The resolution of graphics formed with this strip material was about the same as that for the graphics formed with the strip material of Example 1.

Upon transfer of formed graphics to a substrate there was a slightly greater tendency for the receiving web to skid on the melted layer of adhesive material as compared to the strip material of Example 1. However, this tendency was much less pronounced than with the strip material of Example 4. When a resistance heating member 41 as in FIG. 5 was used to transfer the graphics, the softened adhesive material had only a slight tendency to transfer to the substrate, and that portion that did transfer did not leave a pronounced waxy film around the transferred graphics.

EXAMPLE 6

A strip material was made as in Example 1, except that 20 parts of the ethylene/vinyl acetate copolymer ("Elvax" 460) was used, and the paraffin wax and the polymerized hydrocarbon were omitted.

The resolution of the graphics formed with this strip material was as good or better than that for the graphics formed with the strip material of Example 1, presumably because of the more aggressive adhesion of the adhesive material of the present example.

Upon transfer of formed graphics to a substrate, there was little tendency for the donor web 17 to skid on the melted layer of adhesive material 15. However, when a resistance heater 41, as in FIG. 5, was used to transfer the graphics, a rather high proportion of the adhesive layer transferred to the substrate.

EXAMPLE 7

A strip material was made as in Example 1, except that the receiving web was a cast-coat high gloss white litho paper (60 lb./ream). The face of the receiving web opposite the adhesive layer had a pressure-sensitive adhesive coating which was protected by a silicone-treated paper overlay.

The resulting strip material, which had the structure illustrated in FIG. 8, was exposed to patterns of radiation in the manner described in Example 1 except that the radiation was directed through the donor web. The resolution of the graphics was excellent, being only slightly less than that of the graphics formed with the strip material of Example 1. The receiving web carrying the graphics was readily applied to a substrate via the pressure-sensitive adhesive after the overlay had been stripped away.

EXAMPLE 8

A dispersion was prepared by charging to a container 400 parts of one eighth inch (3 millimeters) diameter steel balls, 16 parts of acicular $\gamma$-$Fe_2O_3$ particles of 0.5 micron particle length and having a 4 to 1 length to width ratio, 0.6 part of a phosphorylated ethoxylated long-chain alcohol surfactant and 18 parts toluene. The container was closed and vigorously shaken for 19 minutes, after which was added 21 parts of a 35.6% solution of vinly chloride copolymer, type VYHH, in methyl ethyl ketone, and the container was again shaken for 3 minutes. The balls were strained from the resulting dispersion, and the dispersion was knife coated on a one-mil biaxially-oriented polyethylene terephthalate web and dried at about 93° C to provide a transfer tape having a one-mill layer of microgranules. The microgranules of iron oxide were so loosely adhered to the donor web 17 that they could be easily wiped away with the finger or washed away under a stream of water at normal tap pressure.

This transfer tape and the accepting tape of Example 4 were positioned in face-to-face relationship. The resulting strip material was subjected to a pressure of about 50 pounds per square inch (3.5 kilograms per square centimeter) and exposed through the accepting tape using a copper coated reflective template for about 2 milliseconds with the xenon flash lamp having a power input of over 50 watt seconds per square inch of exposed area (7.7 watt seconds per square centimeter of exposed area). Sharply defined graphics were formed on the accepting tape.

The negative of the graphics on the transfer tape showed that the microgranules in the exposed areas of the layer of microgranules had completely transferred to the waxy material. The graphics on the receiving web were unaffected when held under a stream of water at normal tap pressure or when wiped with the finger, which demonstrated that the waxy material had penetrated completely through the porous microgranular layer.

EXAMPLE 9

To prepare a dispersion of coloring material and microgranules for making a transfer tape 12*a* as shown in FIG. 2, an open mixing vessel was charged with 165 parts of deionized water, 100 parts titanium dioxide, and 10 parts of a sodium salt of a condensed napthalene sulfonic acid (e.g., "Tamol S.N."). The charge was mixed for about 5 minutes, after which the resultant mixture was pumped through a sandmill charged with one thirty-second inch (0.8 millimeter) diameter glass beads until the mixture appeared mirror smooth under a sixty-power microscope fitted with an oblique light source.

400 parts of a 50% aqueous dispersion of acid-modified ethylene/vinyl acetate copolymer (e.g., "Elvax" D-1288) were then charged to an open vessel fitted with a motorized propeller mixer, and the sandmilled mixture was slowly added thereto, with care being taken not to mix air into the resulting dispersion.

This dispersion was coated with a knife coater and dried at a temperature of less than 60° C to form a 250-microinch (6 micrometer) dry layer 52 on a biaxially-oriented polyethylene terephthalate donor web 17*a*. The dry layer was generally microgranular and almost free from voids.

A dispersion for making a pigmented coating 54 as shown in FIG. 2 was prepared using a binder, about 4 parts by weight of which was a polyurethane elastomer (e.g., "Estane" 5703) prepared by reacting a hydroxyl-terminated polyester of 1,4-butanediol and adipic acid with p,p'-diphenylmethane di-isocyanate and 1,4-butanediol while maintaining an isocyanate: hydroxyl ratio somewhat less than 0.99 to yield a stable polymer with terminal hydroxyl groups. About one part by weight of the binder was a high molecular weight thermoplastic copolymer of equivalent amounts of bisphenol A[i.e., 2,2-bis( 4-hydroxyphenyl)propane] and the diglycidyl ether of bisphenol A (referred to hereinafter as Phenoxy resin). To a water-cooled ball mill were charged solutions of about one-fourth of the binders together with carbon black and phosphorylated ethoxylated long-chain alcohol surfactant. After milling until a smooth dispersion was obtained, the balance of the binder was added with continued milling to obtain a smooth coatable dispersion. Added immediately prior to coating was a cross-linking agent, namely, a polymethylene polyphenyl isocyanate having on the average 3.2 isocyanato groups per molecule (e.g., "PAPI" of the Polychemical Division of Upjohn Co.). Using a gravure roll, a coating was applied to a biaxially-oriented polyethylene terephthalate receiving web 14a. The coating after smoothing and heating to dryness had a thickness of about 50 microinches (1.25 micrometers). The coating contained about 12 parts by weight of carbon black per 100 parts of cross-linked binder. Over this dried coating was applied a 200microinch (5-micrometer) layer 15a of the adhesive material used in Example 1 to provide an accepting tape 11a as shown in FIG. 2.

The accepting tape 11a and the transfer tape 12a were positioned face-to-face, subjected to a pressure of about 50 pounds per square inch (3.5 kilograms per square centimeter), and exposed through the receiving web 17a using a copper-coated reflective template for about 2 milliseconds with the xenon flash lamp having a power input of 50 watt seconds per square inch of exposure area (7.7 watt seconds pre square centimeter of exposure area). Sharply defined graphics were formed.

When the donor and receiving webs 17a and 14a were subsequently separated, the entire thickness of the microgranular layer 52 in the irradiated areas of the strip material was adhered to the adhesive layer 15a on the receiving web 14a.

Graphics 37 formed on the accepting tape 11*9* were easily transferred to a fibrous substrate such as paper by positioning the graphics adjacent the substrate and applying a heater 41 as in FIG. 5 at 80°–115° C to the receiving web 14a. The graphics had little tendency to slip and deform during application. Most of the layer of adhesive material 15a remained on the receiving web 14a subsequent to the transfer, and that adhesive material which did not transfer did not substantially discolor the substrate.

Microgranules remaining on the donor web 17a which had openings corresponding to the graphics 37 formed on the accepting tape, could be easily transferred from the donor web 17a to a fibrous substrate by use of the heater 41 in the manner previously described.

EXAMPLE 10

Two grams of the above-described Phenoxy resin and 198 grams of cyclohexanone were mixed for five minutes in a shaker to dissolve the Phenoxy resin. The solution was coated onto one-mill (.025 mm) transparent biaxially-oriented polyethylene terephthalate film using a gravure metering roll with a 70-line per inch (178-line per cm) knurl. The resultant coating was smoothed by contact with a curved smoothing blade and dried at 50° C. The dried coating thickness was 30 microinches (0.75 micrometer). When this coated film was used as the accepting tape with the transfer tape described in Example 1, excellent first and second transfers are obtained.

When a 5% solution of the Phenoxy resin was used to provide a coating thickness in excess of 100 microinches (2.5 micrometers), excellent first transfers were obtained. The accepting tape bearing the transferred graphics tended to adhere to paper substrates to which it was applied.

The same phenomena were noted when low-molecular-weight terephthalate polyesters were used in place of the Phenoxy resin.

As used in this specification the term "radiation transparent" means transmissive of heat-producing radiant energy, and the term "radiation-absorbing pigment" refers to a pigment which is heated by absorption of heat-producing radiant energy.

We claim:

1. A method of composing a series of graphics such as letters, numbers, symbols or pictures comprising the sequential steps of:

providing an accepting tape comprising a layer of latent adhesive material, which adhesive material is nontacky at normal room temperature, but is softened and activated when heated to a temperature range slightly above normal room temperature; and a transfer tape comprising a donor web and a layer of microgranules of up to 5 micron average diameter releasably adhered to said donor web, at least one of said layers bearing a radiation absorbing pigment and at least one of said tapes being essentially transparent to radiant energy from one exterior surface at least to said pigment;

positioning said layers of said tapes in face-to-face contact to provide a composite strip material;

briefly and sequentially directing radiation toward successive areas on said exterior surface of the composite strip material, said radiation having sufficient energy to heat said radiation absorbing pigment above the softening range of said adhesive material, while reflectively masking said directed radiation except in successive graphic patterns so that the layer of adhesive material softens selectively in the successive graphic patterns and adheres to the layer of microgranules to provide a series of visible graphic patterns corresponding to the pattern of radiation; and separating the accepting tape and donor web to transfer microgranules to the accepting tape in the configuration of the visible graphic patterns.

2. The method of claim 1, wherein said microgranules comprise a thermoplastic resin which softens at a temperature above the softening range of the adhesive material, and the method includes the subsequent steps of:

positioning the separated accepting tape with its microgranules in contact with a substrate;

applying sufficient heat through the accepting tape to adhere the resin to the substrate; and peeling the accepting tape away.

3. The method of claim 1, wherein said microgranules comprise a thermoplastic resin, and the method includes the subsequent steps of:

positioning the separated donor web with its microgranules in contact with a substrate;

applying sufficient heat through the donor web to adhere the resin to the substrate; and peeling the donor web away.

4. The method of claim 1 wherein said microgranules comprise a thermoplastic resin which softens at a temperature above the softening range of the adhesive material, and the method includes the subsequent steps of:

positioning the separated accepting tape or donor web with its microgranules in contact with a substrate; and applying sufficient heat to adhere the microgranules to the substrate.

* * * * *